United States Patent [19]

Viniczay et al.

[11] 4,365,654

[45] Dec. 28, 1982

[54] THREAD MONITORING APPARATUS FOR TEXTILE MACHINES

[75] Inventors: Gabriella F. Viniczay, Steinach; Kurt Huber, Arbon, both of Switzerland

[73] Assignee: Aktiengesellschaft Adolph Saurer, Arbon, Switzerland

[21] Appl. No.: 182,456

[22] Filed: Aug. 28, 1980

[30] Foreign Application Priority Data

Sep. 17, 1979 [CH] Switzerland ..... 8373/79

[51] Int. Cl.[3] ..... D03D 51/34

[52] U.S. Cl. ..... 139/370.2; 66/163; 250/561; 250/571; 340/677

[58] Field of Search ..... 139/370.2, 370.1, 336, 139/353; 66/163; 28/187; 112/273; 340/677; 307/116; 250/559, 561, 571

[56] References Cited

U.S. PATENT DOCUMENTS 3,802,468 4/1974 Meyer et al. ..... 139/370.2
3,863,241 1/1975 Kamiyamaguchi et al. .... 139/370.2 X
4,095,621 6/1978 Kakinaka ..... 139/370.2
4,267,554 5/1981 Loepfe et al. ..... 340/677

FOREIGN PATENT DOCUMENTS 45-11473 4/1970 Japan ..... 139/370.2

*Primary Examiner*—James Kee Chi
*Attorney, Agent, or Firm*—Werner W. Kleeman

[57] ABSTRACT

A weft or filling thread monitor comprises a wire-shaped feeler pin which is pivoted by a thread, against the action of spring force, in the region of a measuring field. The measuring field encompasses a light-emitting diode and a photocell and enables generating, in a contactless manner by the feeler pin, an electrical control signal which is related to the monitored thread. This control signal is infed to a first input of a gate switching stage, at the second input of which there is applied a machine-controlled reference signal. In the absence of the control signal there appears at the output a work signal suitable for shutdown of the machine. Due to these measures such thread monitoring apparatus, working with contactless signal triggering, can fulfil all of the requirements placed thereon.

10 Claims, 3 Drawing Figures

THREAD MONITORING APPARATUS FOR TEXTILE MACHINES

BACKGROUND OF THE INVENTION

The present invention relates to a new and improved construction of thread monitoring apparatus for textile machines.

More specifically, the invention relates to a filling or weft thread monitoring apparatus, particularly suitable for use with shuttleless looms, which comprises a thread feeler encompassing a thread scanner and pivotable relative to the thread. The thread feeler coacts with an electrical circuit arrangement for generating a fault signal. This circuit arrangement contains a measuring cell generating a thread signal and through which there can move the thread feeler as well as a switching stage for comparison of the thread signal with a machine-controlled reference signal.

At thread processing textile machines, such as for instance shuttleless looms, it is necessary to monitor the thread, for instance as to its presence or availability. For this purpose there is used a weft thread-monitoring apparatus of the previously mentioned type at locations of a momentary relative transverse movement between a thread and a machine element, for instance approximately at the region of the reed movement, by means of which the weft thread is beaten at the cloth fell.

With one such type monitoring apparatus, conventionally known in the art as a filling or weft thread monitor, the thread feeler is constituted by a wire bracket fixedly arranged at the weaving reed or the comb or the sley or at the loom. This wire bracket forms part of an electrical circuit for the shutdown of the loom. During the beating movement of the sley the wire bracket moves towards a contact element, and if there is properly present weft thread then the wire bracket is restrained from making contact. On the other hand, if the weft or filling thread is absent, then the electrical circuit between the wire bracket and the contact element is closed by making contact and the machine is shutdown.

Now it has been found for considerable time that such arrangements are not capable of insuring for a positive contact at all points in time, since the wire bracket possesses too little stability for a switching element.

In Swiss Pat. No. 496,121 there has been disclosed to the art an apparatus of the previously mentioned type, wherein a feeler fork is subjected to the positioning pressure of a spring. Hence, the feeler fork contacts the thread with a relatively large acceleration. This requires, however, that the thread at the therein not particularly illustrated warp threads be supported closely to both sides of the individual feeler fork tines, so that the filling or weft threads are not depressed by the arriving feeler fork, and thus, there is produced a pulse at the feeler fork hub by a light barrier interrupter. In this case the smaller the warp thread density that much less useful becomes this arrangement.

SUMMARY OF THE INVENTION

Therefore, with the foregoing in mind it is a primary object of the present invention to provide a new and improved construction of thread monitoring apparatus for textile machines which is not associated with the aforementioned drawbacks and limitations of the prior art constructions.

Another and more specific object of the present invention aims at providing a weft thread-monitoring apparatus of the previously mentioned type, which while avoiding the aforementioned disadvantages, employs a thread feeler which is only subjected to the contact pressure of the weft thread, but however nonetheless fulfils a positive signal giving function under all possible operating conditions.

Yet a further significant object of the present invention aims at providing a new and improved construction of thread monitoring apparatus for textile machines, which is relatively simple in construction and design, extremely reliable in operation, not readily subject to breakdown or malfunction, requires a minimum of maintenance and servicing, and provides for positive detection of the presence of the monitored threads or other filamentary material.

Now in order to implement these and still further objects of the invention, which will become more readily apparent as the description proceeds, the thread monitoring apparatus of the presence development is manifested by the features that the thread scanner is constituted by a feeler or scanner pin which can be pivoted against the action of a restoring spring and thus passes in a contactless manner through the measuring field. Further, the circuit stage for comparison of the thread signal with the machine-controlled reference signal has connected forwardly thereof a blocking switching stage for suppressing a continuous signal generated by the measuring field. The machine-controlled reference signal is simultaneously connected to a further circuit arrangement for generating a further fault signal. This further circuit arrangement contains a circuit stage for comparison of the reference signal carried by means of a threshold value switch with at least one further machine-controlled reference signal. By virtue of these measures it is now possible to absolutely positively scan or feel the filling or weft threads which are to be monitored as to their presence or as to their correct retention at their end points, at random locations of their extent, in that in this case the thread, during its beating movement, itself comes into contact with the feeler pin which has only been pre-biased or stressed minimumly for its return movement and rocks or pivots such through the measuring field. Furthermore, there is accomplished a complete self-monitoring operation in that, not only upon absence of the thread signal from the measuring cell, but also in the presence of a continuous signal produced by the measuring field as well as also upon absence of the machine-controlled reference signal, there is generated a fault or work signal, respectively.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
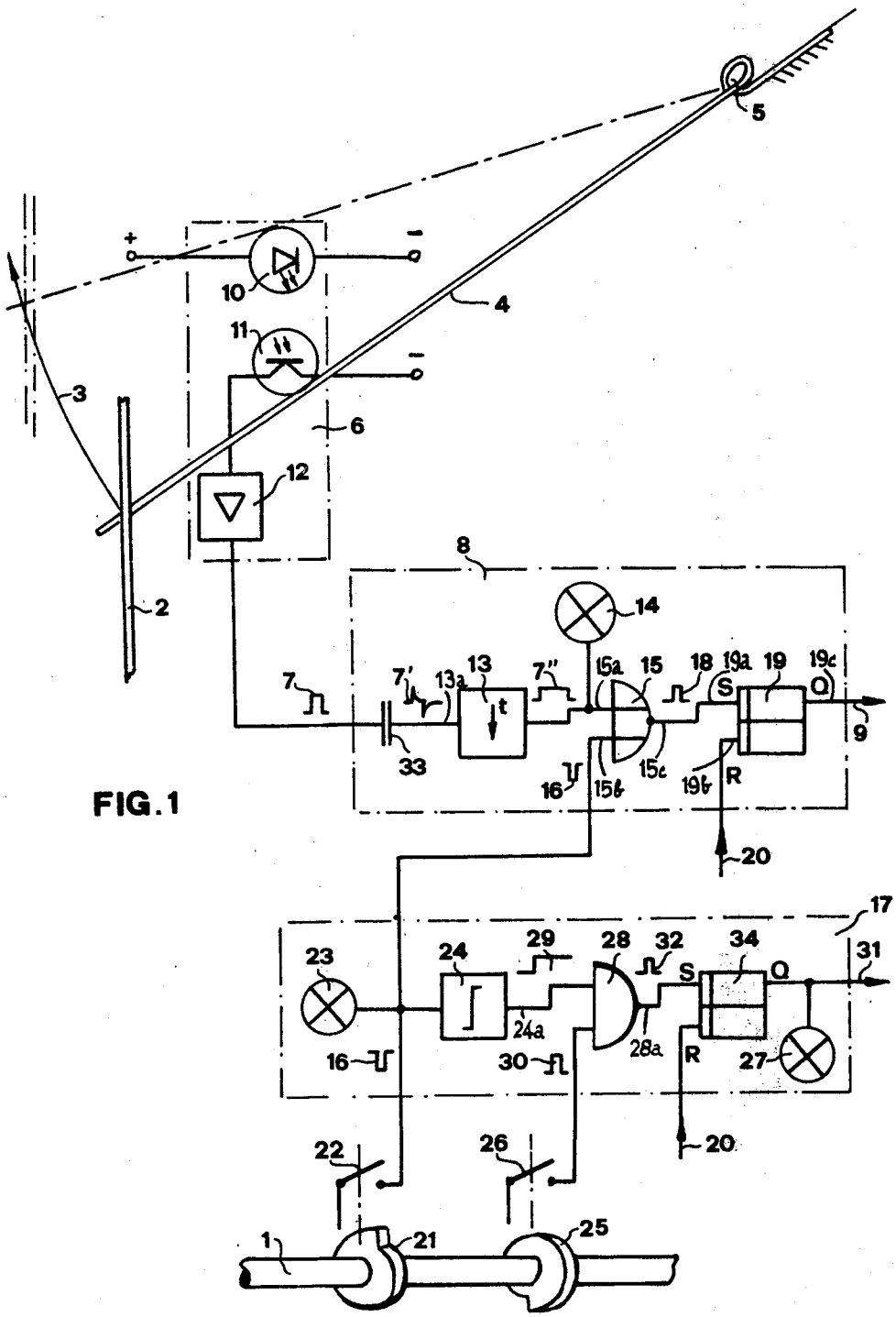
FIG. 1 is a schematic illustration including a circuit diagram of a thread monitoring apparatus according to the invention.
Figure 2:
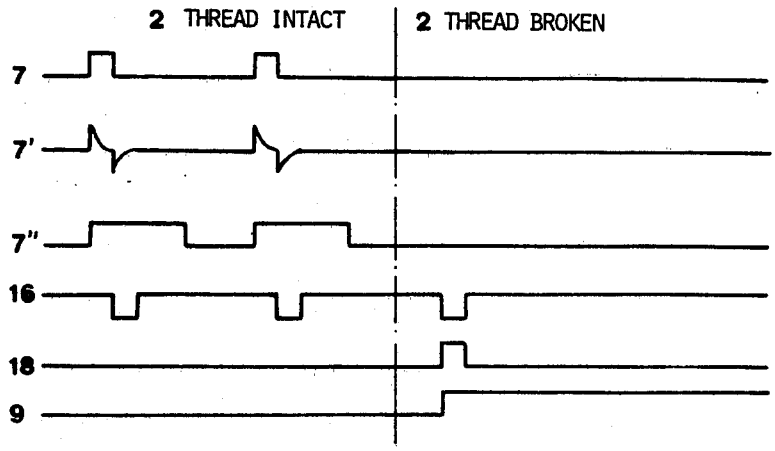
FIG. 2 graphically illustrates the course of the thread control and reference signals when the weft or filling threads are respectively intact and broken.
Figure 3:
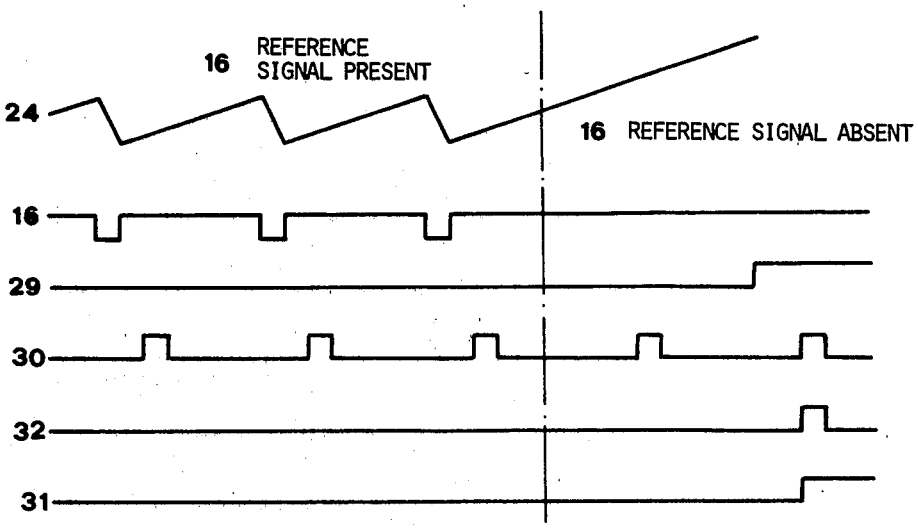
FIG. 3 is a graphical illustration of the course of the signal of the inherent control of the apparatus during the respective presence and absence of the reference signal.

Describing now the drawings, the illustrated weft thread-monitoring apparatus, as shown by way of example and not limitation, here is depicted as a weft thread monitor for use in conjuction with a shuttleless loom which may be of any well known construction. As such, the loom has only been schematically represented by the loom or machine shaft 1 and a filling or weft thread 2. This filling or weft thread 2 is displaceable transversely with respect to its lengthwise extent and along the direction of the arrow 3 into the broken line position, which for instance represents the situation when a filling or weft thread which has been inserted into the weaving shed subsequently is beaten-up to the cloth fell, and the weft thread is under a lengthwise tension due to retention of both of its thread ends in thread clamps.

In order to monitor this thread lengthwise tension or for monitoring the presence of the weft or filling thread 2 there is beneficially employed the inventive weft thread monitor. A preferably wire-shaped feeler pin 4 is formed at its one end 5, which is stationary with respect to the transverse motion of the weft thread 2, as a spring and can be pivoted or rocked against the action of the spring force, likewise in the direction of the arrow 3, through a predetermined pivot angle. The weft or filling thread 2 which is moved for beating against the cloth fell comes into contact with the free end of the feeler pin 4 and, with orderly weft thread condition, entrains such against its spring force until it assumes the broken line position of FIG. 1.

Of course, the feeler pin 4 also could possess a different spring-elastic resilience, for instance could be constructed as a tongue-shaped member. Equally, there also could be provided a pivot bearing containing an external spring. Furthermore, the feeler pin 4 also could be provided at the region of its contact with the weft thread with a plastic or porcelain covering or the like.

At the pivotal region of the feeler pin 4 there is arranged, according to the invention, a measuring field or zone 6, through which passes the feeler pin 4 preferably in its broken or phantom line illustrated end position or during its movement towards such end position. This measuring field or zone 6 forms an input stage of a circuit arrangement 8 for generating an electrical work signal 9. This input stage of the circuit arrangement 8 delivers an electrical control signal 7 which is related to the weft or filling thread 2. The measuring field or zone 6, which can consist of a photoelectric or capacitive or inductive measuring element or the like, is here illustrated by way of example and not limitation as a photoelectic measuring element containing a light-emitting diode 10 and a photocell 11.

The control signal 7 delivered by the measuring element 10, 11 of the measuring field or zone 6, and amplified by a signal amplifier stage 12, is infed as an input signal 7' by means of a capacitor 33 to the input **13*a* of a conventional timer switching stage or timer 13 where it is prolonged in time and then arrives as a prolonged control signal 7'', while being simultaneously optically displayed by the lamp or luminescent diode 14, at one input 15*a* of a suitable gating switching stage or logic gate 15. The other input 15*b* of the gating switching stage 15 has infed thereto a reference signal 16**.

As is to be readily understood the output **15*c* of the gating switching stage or logic gate 15 then assumes the logic state null when both the thread-indicating control signals 7''' and also the machine-controlled pulse-shaped reference signal 16 are present. On the other hand, there appears at the output 15*c* of the gating switching stage 15 a pulse-shaped signal 18 which is representative of an improper thread whenever there does not appear the control signal 7''. This signal 18 is infed to the input 19*a* of a bistable flip-flop 19, constituting the output stage of the circuit arrangement 8, and at the output 19*c* of which there appears the work signal 9 for shutdown of the loom and, if desired, for initiation of further switching functions, such as indication of the fault, reversal of the machine and so forth. Upon renewed start of the machine, i.e. the loom, after eliminating the fault the bistable flip-flop 19 can be reset by means of an appropriate signal 20 into the switching state needed for loom operation. The resetting signal 20 is infed to the other input 19*b* of the bistable flip-flop 19**.

In order to generate the machine-controlled reference signal 16 there is provided a reference circuit arrangement 17 which coacts with the loom shaft 1 by means of a so-called probe, which here has been represented by a cam 21 revolving with the shaft 1 and a cam-controlled contact 22. Such probes 21, 22 can be readily adjusted to the operating conditions, here for instance to an optimum standstill position for a non-influencable brake angle of the loom. Also in this case the reference signal 16 can be optically displayed by a luminescent diode 23.

The self-monitoring of the entire system is accomplished in two stages. An interrupted thread signal 7 need not however be monitored, since such corresponds to the case where the weft or filling thread 2 is not present.

However, if there appears a continuous signal at the input side of the circuit arrangement 8, then the capacitor 33, as illustrated in FIG. 1, prevents the timer switching stage 13 from generating a prolonged or continuous signal 7''. Therefore, standstill of the machine is accomplished by means of the gate switching stage 15 and the bistable flip-flop 19. The reference signal 16 from the contact 22, constituting a pulse transmitter, is infed, on the one hand, to the gating switching stage 15 of the circuit arrangement 8 and, on the other hand, to a threshold value-switching stage 24 provided at the circuit arrangement 17. The potential at the threshold value-switching stage 24 is brought to null by each cycle-like appearing reference signal 16 and ascends during the pauses between two references signals 16, to a value at which there does not appear any output signal 29. If the reference signal 16 is interrupted, then the potential or voltage of the threshold value-switching stage 24 ascends to a value at which there appears at the output **24*a* of such switching stage 24 the signal 29. This signal 29 causes the logic gate or gating stage 28 to deliver at its output 28*a* a signal 32. There is applied to the gating stage or circuit 28 likewise a reference signal or signals 30 of one or a number of pulse transmitters 25, 26, which can be constructed like the pulse transmitter 21, 22 previously discussed, this pulse transmitter 25, 26 serving as the reference signal transmitter, as a rule, can perform other functions, for instance the function of monitoring the warp threads of the loom. The signal 32 causes a work signal 31 to appear at the output Q of a bistable flip-flop stage 34. Connected with the output Q is a display lamp 27 which indicates when the pulse 16** is absent or continuously present, to thus signal a defect in the operation. The bistable flip-flop stage 34 is reset, during start of the loom, with the same reset signal 20 which is infed to the bistable flip-flop stage 19 of the circuit arrangement 8. A continuous signal 16 from the pulse transmitter 21, 22 need not be monitored, since in the pauses between signals 7'' there is triggered a signal 18, so that by means of the bistable flip-flop stage 19 there is then triggered a work signal 9.

Due to these measures there are not only fulfilled all of the requirements which are to be placed upon a thread monitoring apparatus of the described type, but also there is obtained a comprehensively effective inherent or self-monitoring.

Naturally, within the framework and teachings of the invention there can be undertaken an entire series of modifications. In particular, it can be necessary to incorporate between the amplifier 12 for the control signal 7 and the timer switching stage 13 a preferably controllable threshold value-switching stage, in order to prevent undesired switching operations from arising, for instance caused by fiber fly and the like appearing at the region of the measuring zone or field 6.

While there are shown and described present preferred embodiments of the invention, it is to be distinctly understood that the invention is not limited thereto, but may be otherwise variously embodied and practiced within the scope of the following claims. Accordingly,

What we claim is:

1. A weft thread-monitoring apparatus, especially for shuttleless looms, comprising:

a thread feeler encompassing a thread scanner which can be transversely pivoted relative to the movement of the monitored weft thread;

a first electrical circuit arrangement with which there is operatively connected said thread feeler;

said first electrical circuit arrangement serving for generating a fault signal;

said first electrical circuit arrangement including means defining a measuring field generating a thread signal;

said thread feeler moving through said measuring field;

a circuit stage cooperating with said first electrical circuit arrangement for comparison of the thread signal with a machine-controlled reference signal;

said thread scanner comprising a feeler pin which passes in contactless manner through the measuring zone and can be rocked by the weft thread against the action of a restoring spring;

a blocking circuit stage for suppressing a continuous signal generated by the measuring field arranged forwardly of the circuit stage serving for comparison of the thread signal with the machine-controlled reference signal;

a further circuit arrangement to which there is simultaneously infed said machine-controlled reference signal;

said further circuit arrangement serving to generate a further fault signal;

said further circuit arrangement comprising a circuit stage for comparison of the reference signal infed by means of a threshold value switch with at least one further machine-controlled reference signal.

2. The weft thread-monitoring apparatus as defined in claim 1, wherein:

said measuring field comprises a measuring element.

3. The weft thread-monitoring apparatus as defined in claim 2, wherein:

said measuring element comprises an optoelectrical measuring element.

4. The weft thread-monitoring apparatus as defined in claim 2, wherein:

said measuring element comprises a capacitive measuring element.

5. The weft thread-monitoring apparatus as defined in claim 2, wherein:

said measuring element comprises an inductive measuring element.

6. The weft thread-monitoring apparatus as defined in claim 1, wherein:

said blocking circuit stage comprises a capacitor.

7. The weft thread-monitoring apparatus as defined in claim 1, wherein:

said comparison circuit stage of the first circuit arrangement comprises a gating switching stage having a first and second input;

said thread signal being applied to said first input; and said machine-controlled reference signal being applied to said second input.

8. The weft thread-monitoring apparatus as defined in claim 7, further including:

a bistable flip-flop stage connected in circuit after said gating switching stage and constituting an output stage of the first circuit arrangement.

9. The weft thread-monitoring apparatus as defined in claim 1, wherein:

said comparison circuit stage of the further circuit arrangement comprises a gating switching stage having a first input and a second input;

the output signal of the threshold value switch being applied to the first input; and the further machine-controlled reference signal being applied to the second input.

10. The weft thread-monitoring apparatus as defined in claim 9, further including:

a bistable flip-flop stage connected in circuit following said gating switching stage and constituting the output stage of the further circuit arrangement.

* * * * *